US012571202B2

(12) United States Patent
Halterman

(10) Patent No.: US 12,571,202 B2
(45) Date of Patent: Mar. 10, 2026

(54) SYSTEM AND METHOD FOR ASSEMBLING MODULES

(71) Applicant: SIEMENS ENERGY GLOBAL GMBH & CO. KG, Munich (DE)

(72) Inventor: Brandon Halterman, Winter Springs, FL (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 312 days.

(21) Appl. No.: 18/291,482

(22) PCT Filed: Aug. 31, 2021

(86) PCT No.: PCT/US2021/071322

§ 371 (c)(1),
(2) Date: Jan. 23, 2024

(87) PCT Pub. No.: WO2023/033856

PCT Pub. Date: Mar. 9, 2023

(65) Prior Publication Data

US 2025/0092667 A1 Mar. 20, 2025

(51) Int. Cl.
*E04B 1/348* (2006.01)

(52) U.S. Cl.
CPC ..... *E04B 1/3483* (2013.01)

(58) Field of Classification Search
CPC ..... E04B 1/3483; E04B 1/346; E04B 1/41; E04B 1/343; E04B 1/24; E04B 1/2403; E04B 2001/2406

(Continued)

(56) References Cited

U.S. PATENT DOCUMENTS 3,563,581 A * 2/1971 Sommerstein ..... F16B 7/0486 403/217
3,925,679 A 12/1975 Berman et al.
(Continued)

FOREIGN PATENT DOCUMENTS

EP 3366903 A1 8/2018
JP H07243239 A 9/1995
(Continued)

OTHER PUBLICATIONS

PCT International Search Report and Written Opinion of the International Searching Authority mailed Jun. 2, 2022 corresponding to PCT Application No. PCT/US2021/071322 filed Aug. 31, 2021.

*Primary Examiner* — Paola Agudelo

(57) ABSTRACT

A system for assembling modules includes a first module having a first set of columns defining a first space. A first column of the first module defines a first hollow interior. The system includes a second module having a second set of columns defining a second space. A first column of the second module defines a second hollow interior. The system includes a first plate fixed within the first hollow interior. The system includes an alignment pin coupled to the first plate. The system includes a second plate that has a hole to receive the alignment pin and is engaged with the alignment pin to position the second plate in an aligned position with respect to the first column of the module. The second plate is fixedly attached to the first column of the second module in the aligned position within the second hollow interior.

20 Claims, 6 Drawing Sheets

(58) Field of Classification Search
USPC ..... 52/79.13; 410/77
See application file for complete search history.

(56) References Cited

U.S. PATENT DOCUMENTS

| | | | | |
|---|---|---|---|---|
| 6,390,719 | B1 * | 5/2002 | Chan | E04B 1/5806 52/646 |
| 11,105,088 | B2 * | 8/2021 | Binder | E04C 3/07 |
| 11,407,582 | B2 * | 8/2022 | Hirsh | B65D 90/24 |
| 11,746,550 | B2 * | 9/2023 | Bass | G21C 13/00 52/741.12 |
| 12,163,328 | B2 * | 12/2024 | Ligeti | E04B 1/3483 |
| 2005/0076484 | A1 * | 4/2005 | Sussenbach | F16B 21/186 24/662 |
| 2014/0137486 | A1 * | 5/2014 | Driess | E04H 5/00 52/745.03 |
| 2019/0078321 | A1 * | 3/2019 | Bowron | E04H 1/005 |
| 2022/0049491 | A1 | 2/2022 | Yoshitaka | |
| 2022/0106784 | A1 * | 4/2022 | Igarashi | E04B 1/34869 |
| 2023/0125829 | A1 * | 4/2023 | Parkhouse | E04B 1/3483 52/79.13 |

FOREIGN PATENT DOCUMENTS

| | | | |
|---|---|---|---|
| WO | 2020201735 | A1 | 10/2020 |
| WO | 2020240745 | A1 | 12/2020 |

* cited by examiner

SYSTEM AND METHOD FOR ASSEMBLING MODULES

BACKGROUND

A gas turbine engine typically includes a compressor section, a turbine section, and a combustion section disposed therebetween. The compressor section includes multiple stages of rotating compressor blades and stationary compressor vanes for compressing air. The combustion section typically includes a plurality of combustors for mixing the compressed air and fuel and producing combustion gases. The turbine section includes multiple stages of rotating turbine blades and stationary turbine vanes that expands the combustion gases to convert the thermal and pressure energy into rotating or mechanical work.

Installation of the gas turbine engine on a site includes install auxiliary components that cooperatively work together with the gas turbine engine. The auxiliary components include piping, valves, instrumentation, junction boxes, conduit and cables, enclosure panels, etc.

BRIEF SUMMARY

In one aspect, a system for assembling modules includes a first module having a first set of columns that cooperate to define a first space. A first column of the first set of columns defines a first hollow interior. The system includes a second module having a second set of columns that cooperate to define a second space. A first column of the second set of columns defines a second hollow interior. The system includes a first plate that is fixedly attached to the first column of the first set of columns within the first hollow interior. The system includes an alignment pin that is fixedly coupled to the first plate. The system includes a second plate having a hole sized to receive the alignment pin. The second plate is engaged with the alignment pin to position the second plate in an aligned position with respect to the first column of the second set of columns. The system includes an attachment member that is fixedly attached to the second plate and the first column of the second set of columns to fixedly attach the second plate in the aligned position within the second hollow interior.

In one aspect, a system for assembling modules includes a first module having a first set of columns that cooperate to define a first space. A first column of the first set of columns defines a first hollow interior. The system includes a first auxiliary package that is installed within the first space. The system includes a second module having a second set of columns that cooperate to define a second space. A first column of the second set of columns of defines a second hollow interior. The system includes a second auxiliary package that is installed within the second space. The system includes a first plate that is fixedly attached at a top end of the first column of the first set of columns within the first hollow interior. The system includes an alignment pin that is fixedly coupled to the first plate. The system includes a second plate having a hole sized to receive the alignment pin. The second plate is engaged with the alignment pin to position the second plate in an aligned position with respect to the first column of the second set of columns that aligns the second auxiliary package with the first auxiliary package when the second module is assembled to the first module. The system includes an attachment member that is fixedly attached to the second plate and the first column of the second set of columns to fixedly attach the second plate in the aligned position at a bottom end of the first column of the second set of columns within the second hollow interior.

In one aspect, a method for assembling modules includes arranging a first module having a first set of columns that cooperate to define a first space. A first column of the first set of columns defines a first hollow interior. The method includes installing a first auxiliary package within the first space. The method includes arranging a second module having a second set of columns that cooperate to define a second space. A first column of the second set of columns defines a second hollow interior. The method includes installing a second auxiliary package within the second space. The method includes fixedly attaching a first plate to a top end of the first column of the first set of columns within the first hollow interior. The method includes coupling an alignment pin to the first plate. The method includes positioning a second plate over the alignment pin. The second plate includes a hole to receive the alignment pin. The method includes adjusting a position of the second plate in an aligned position with respect to the first column of the second set of columns. The method includes stacking the second module on a top of the first module by sliding the first column of the second set of columns over the second plate to place the second plate in the aligned position within the second hollow interior that aligns the second auxiliary package with the first auxiliary package. The method includes fixedly attaching the second plate to the first column of the second set of columns in the aligned position at a bottom end of the first column of the second set of columns within the second hollow interior.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
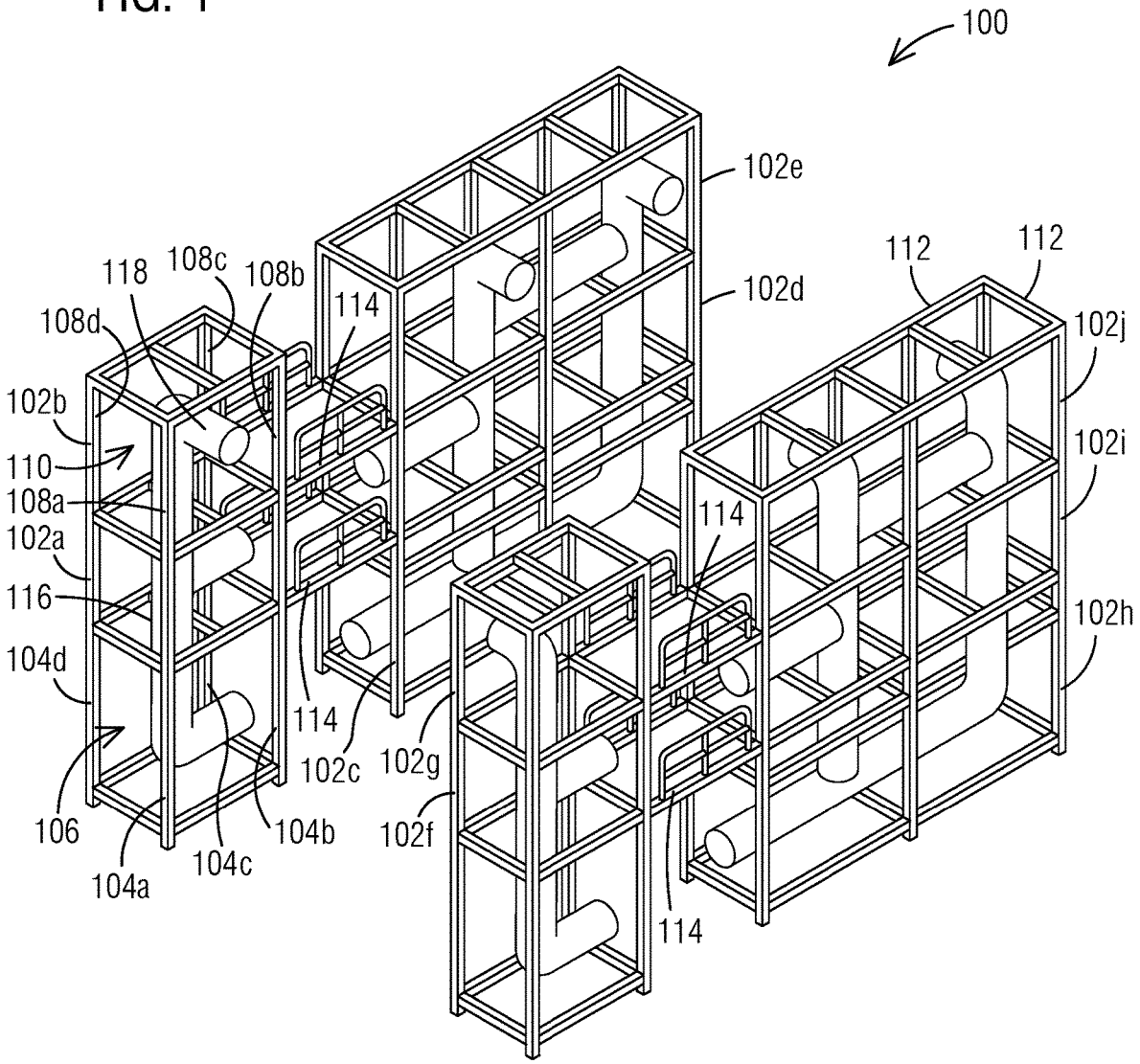
FIG. 1 illustrates a perspective view of a system of assembled modules.

Before any embodiments of the invention are explained in detail, it is to be understood that the invention is not limited in its application to the details of construction and the arrangement of components set forth in this description or illustrated in the following drawings. The invention is capable of other embodiments and of being practiced or of being carried out in various ways. Also, it is to be understood that the phraseology and terminology used herein is for the purpose of description and should not be regarded as limiting.

Various technologies that pertain to systems and methods will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Also, it should be understood that the words or phrases used herein should be construed broadly, unless expressly limited in some examples. For example, the terms "including," "having," and "comprising," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Furthermore, while multiple embodiments or constructions may be described herein, any features, methods, steps, components, etc. described with regard to one embodiment are equally applicable to other embodiments absent a specific statement to the contrary.

Also, although the terms "first", "second", "third" and so forth may be used herein to refer to various elements, information, functions, or acts, these elements, information, functions, or acts should not be limited by these terms. Rather these numeral adjectives are used to distinguish different elements, information, functions or acts from each other. For example, a first element, information, function, or act could be termed a second element, information, function, or act, and, similarly, a second element, information, function, or act could be termed a first element, information, function, or act, without departing from the scope of the present disclosure.

Also, in the description, the terms "axial" or "axially" refer to a direction along a longitudinal axis of a gas turbine engine. The terms "radial" or "radially" refer to a direction perpendicular to the longitudinal axis of the gas turbine engine. The terms "downstream" or "aft" refer to a direction along a flow direction. The terms "upstream" or "forward" refer to a direction against the flow direction.

In addition, the term "adjacent to" may mean that an element is relatively near to but not in contact with a further element or that the element is in contact with the further portion, unless the context clearly indicates otherwise. Further, the phrase "based on" is intended to mean "based, at least in part, on" unless explicitly stated otherwise. Terms "about" or "substantially" or like terms are intended to cover variations in a value that are within normal industry manufacturing tolerances for that dimension. If no industry standard is available, a variation of twenty percent would fall within the meaning of these terms unless otherwise stated.

FIG. 1 illustrates a perspective view of a system 100. The system 100 includes a plurality of modules assembled together. In the arrangement shown in FIG. 1, the system 100 includes a first module 102*a*, a second module 102*b*, a third module 102*c*, a fourth module 102*d*, a fifth module 102*e*, a sixth module 102*f*, a seventh module 102*g*, an eighth module 102*h*, a ninth module 102*i*, and a tenth module 102*j*. The second module 102*b* is stacked on top of the first module 102*a*. The fourth module 102*d* is stacked on top of the third module 102*c*. The fifth module 102*e* is stacked on top of the fourth module 102*d*. The seventh module 102*g* is stacked on top of the sixth module 102*f*. The ninth module 102*i* is stacked on top of the eighth module 102*h*. The tenth module 102*j* is stacked on top of the ninth module 102*i*. In other arrangements, it is possible that the system 100 may include different numbers of modules and assembled together in different ways. Each module is structural steel framed. Other arrangements of frames are also possible.

Each module of the plurality of modules 102*a*-102*j* includes a set of columns. The set of columns extend vertically and cooperate to define a space delimited by the columns. The first module 102*a* includes a first set of columns. The first set of columns includes a first column 104*a*, a second column 104*b*, a third column 104*c*, and a fourth column 104*d*. The first set of columns 104*a*-104*d* of the first module 102*a* cooperate to define a first space 106.

The second module 102*b* includes a second set of columns. The second set of columns includes a first column 108*a*, a second column 108*b*, a third column 108*c*, and a fourth column 108*d*. The second set of columns 108*a*-108*d* cooperate to define a second space 110. The rest of the modules 102*c*-102*j* have the similar configurations of the first module 102*a* and the second module 102*b*.

In the arrangement shown in FIG. 1, each module of the plurality of modules 102*a*-102*j* has a rectangle cross-section shape defined by four columns. In other arrangement, it is possible that the modules have different shapes defined by different numbers of columns. For example, the module may have a triangular cross-section shape defined by three columns, or a pentagon cross-section shape defined by five columns, or an arc cross-section shape defined by at least two columns, etc.

Each column of the plurality of columns in each module is a square cross-section tube. It is also possible that the columns may have any other desired cross-sectional shapes, such as, a rectangular cross-section tube, a triangular cross-section tube, a pentagon cross-section tube, an arc-cross-section tube, or a cylindrical cross-section tube, etc.

Each module of the plurality of modules 102*a*-102*j* includes a plurality of beams 112. Each beam 112 of the plurality of beams 112 extends horizontally between two adjacent vertical columns of a set of columns along a perimeter of the space defined by the set of the columns.

The system 100 includes a plurality of bridge platforms 114 that connect modules. In the arrangement shown in FIG. 1, the system 100 includes four bridge platforms 114. A first bridge platform 114 connects the first module 102*a* and the fourth module 102*d*. A second bridge platform 114 connects the second module 102*b* and the fifth module 102*e*. The third bridge platform 114 connects the sixth module 102*f* and the ninth module 102*i*. The fourth bridge platform 114 connects the seventh module 102*g* and the tenth module 102*j*. In other arrangements, it is possible that the system 100 includes different numbers of bridge platforms 114 that connect to different modules.

Each module of the plurality of modules 102*a*-102*j* includes an auxiliary package installed within a respective space of each module. For example, a first auxiliary package 116 is installed within the first space 106 of the first module 102*a*. A second auxiliary package 118 is installed within the second space 110 of the second module 102*b*. Each auxiliary package includes a respective set of auxiliary components, such as a respective set of piping, valves, instrumentation, junction boxes, conduit and cables, enclosure panels, etc. Auxiliary components of adjacent auxiliary packages are aligned to each other when the modules are assembled.

Figure 2:
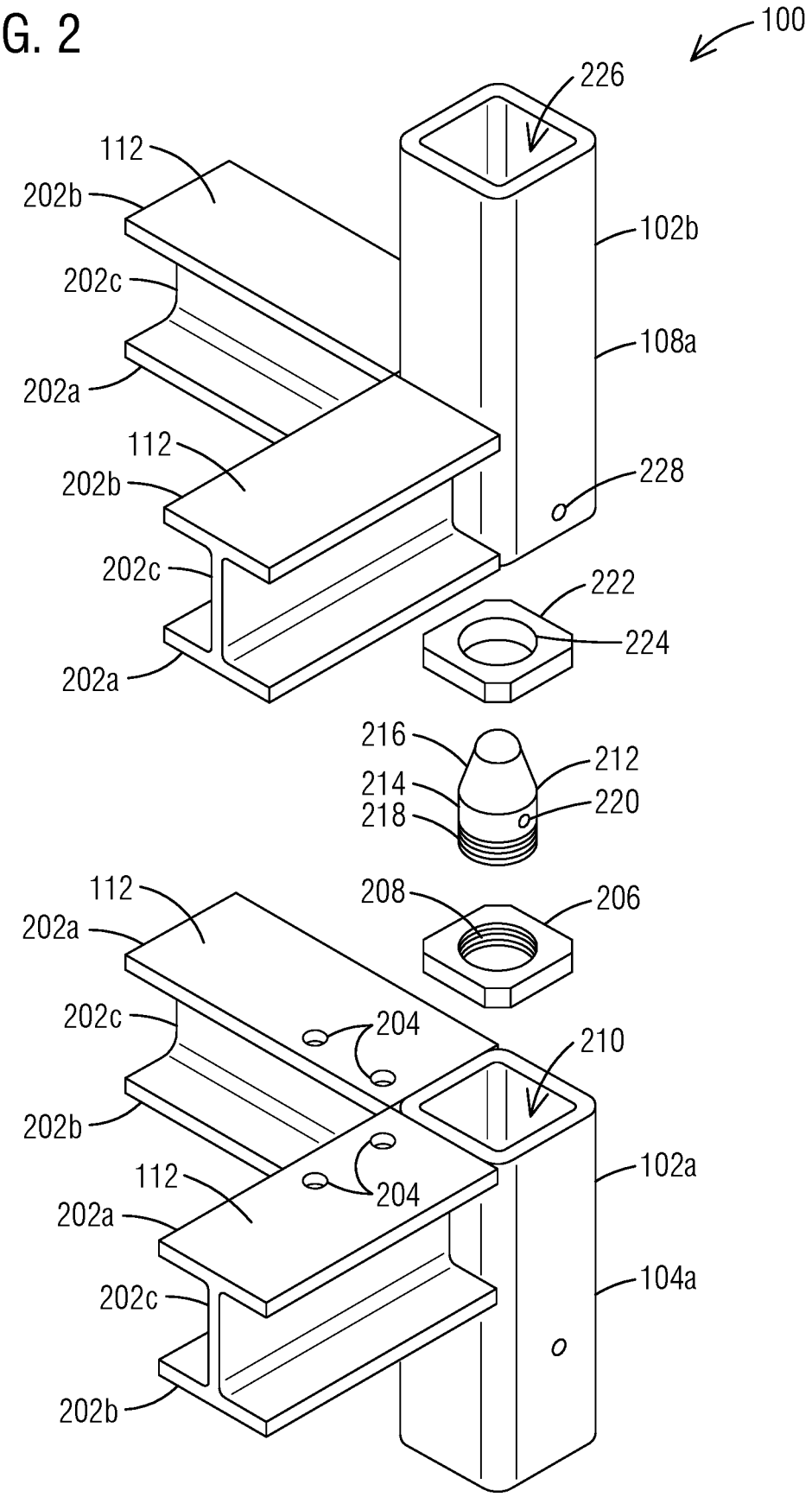
FIG. 2 illustrates a perspective exploded view of a portion of the system in FIG. 1.

FIG. 2 illustrates a perspective exploded view of a portion of the system 100 in FIG. 1. The portion of the system 100 includes the first module 102*a* and the second module 102*b*. The first column 104*a* of the first module 102*a* is a square cross-section tube. The first column 108*a* of the second module 102*b* is a square cross-section tube. It is possible that the first column 104*a* of the first module 102*a* and the first column 108*a* of the second module 102*b* may have other configurations, such as, rectangular cross-section tube, a triangular cross-section tube, a pentagon cross-section tube, an arc-cross-section tube, or a cylindrical cross-section tube, etc.

Two beams 112 extend from two side surfaces of the first column 104*a* of the first module 102*a*, respectively. Each beam 112 of the two beams 112 is an I-shaped beam. Each beam 112 includes a first panel 202*a*, a second panel 202*b*, and a third panel 202*c* that perpendicularly extends between the first panel 202*a* and the second panel 202*b*. The first panel 202*a* is positioned at the top end of the first column 104*a* of the first module 102*a* and is in contact with the second module 102*b* once assembled. The first panel 202*a* includes at least one aperture 204 that cuts through the first panel 202*a*.

The system 100 includes a first plate 206 that includes a threaded hole 208. The threaded hole 208 is defined at a center of the first plate 206. The first plate 206 has a square shape.

The first column 104*a* of the first module 102*a* has a first hollow interior 210 that is defined within the first column 104*a*. Inner corners of the first column 104*a* are chamfered. The first column 104*a* is sized to receive the first plate 206 in the first hollow interior 210. Corners of the first plate 206 are chamfered to fit into the first hollow interior 210.

The system 100 includes an alignment pin 212. The alignment pin 212 has a cylindrical base 214 and a tapered head 216. The alignment pin 212 has a threaded surface 218 on the cylindrical base 214. The alignment pin 212 has an eyelet 220 on the cylindrical base 214.

The system 100 includes a second plate 222 that includes a hole 224. The hole 224 is defined at a center of the second plate 222. The hole 224 is sized to receive the alignment pin 212. The second plate 222 has a square shape.

The first column 108*a* of the second module 102*b* has a second hollow interior 226 that is defined within the first column 108*a*. Inner corners of the first column 108*a* are chamfered. The first column 108*a* is sized to receive the second plate 222 in the second hollow interior 226. Corners of the second plate 222 are chamfered to fit into the second hollow interior 226. The first column 108*a* of the second module 102*b* includes at least one opening 228 positioned at a bottom side of the first column 108*a*.

Two beams 112 extend from two side surfaces of the first column 108*a* of the second module 102*b*, respectively. Each beam 112 of the two beams 112 is an I-shaped beam. Each beam 112 includes a first panel 202*a*, a second panel 202*b*, and a third panel 202*c* that perpendicularly extends between the first panel 202*a* and the second panel 202*b*. The first panel 202*a* is positioned at the bottom end of the first column 108*a* of the second module 102*b* and is in contact with the first module 102*a* once assembled. The first panel 202*a* includes at least one aperture 204 (not shown in FIG. 2) that cuts through the first panel 202*a*.

Figure 3:
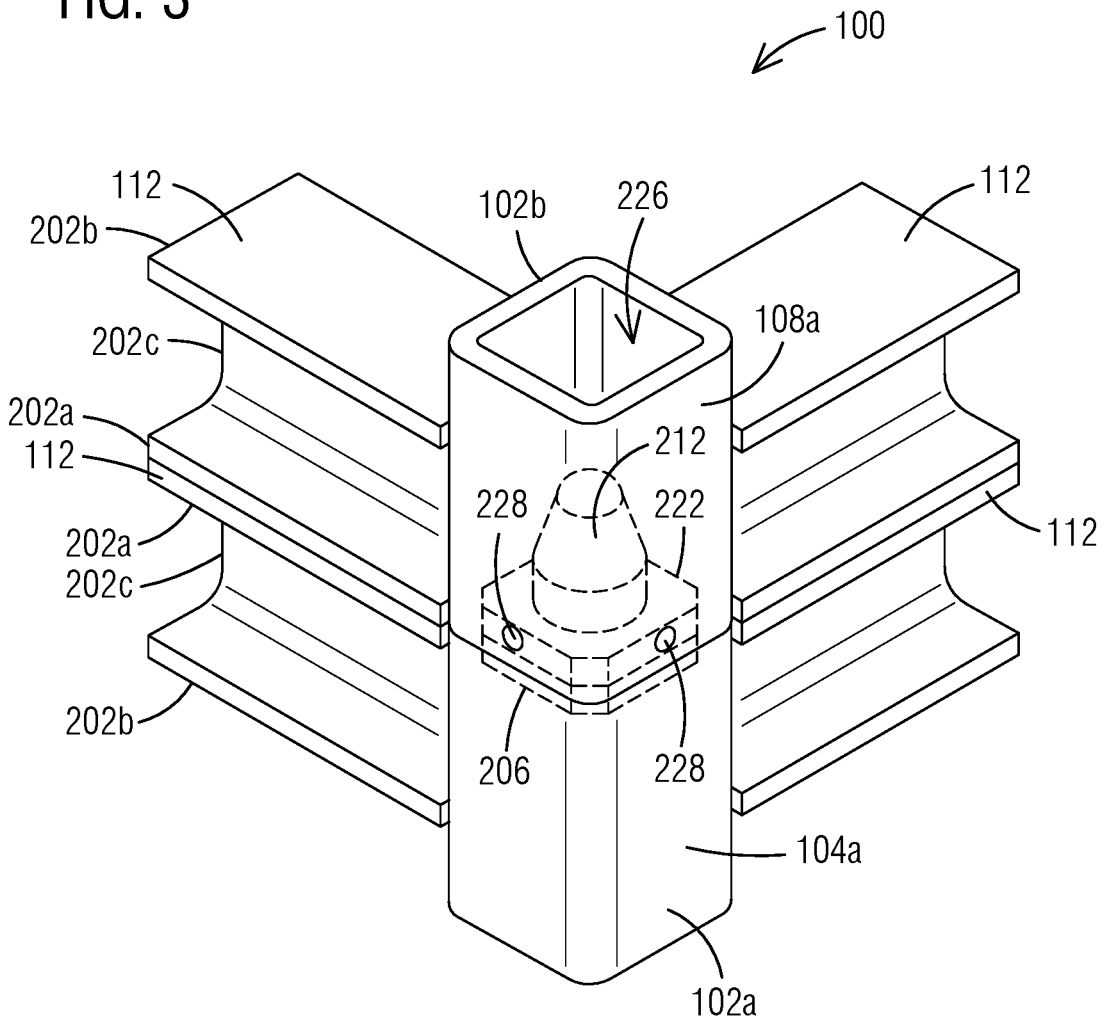
FIG. 3 illustrates a perspective assembled view of the portion of the system in FIG. 2.

FIG. 3 illustrates a perspective assembled view of the portion of the system 100 in FIG. 2. In the assembled configuration, the second module 102*b* is stacked on the top of the first module 102*a*. The first plate 206 is fixedly attached within the first hollow interior 210 of the first column 104*a* of the first module 102*a* at a top end that is in contact with the second module 102*b*. The alignment pin 212 is installed into the first plate 206 by threading the threaded surface 218 into the threaded hole 208 of the first plate 206. The second plate 222 is engaged with the alignment pin 212 through the hole 224 of the second plate 222. The second plate 222 is positioned within the second hollow interior 226 of the first column 108*a* of the second module 102*b* at a bottom end that is in contact with the first module 102*a*. The second plate 222 is fixedly attached to the first column 108*a* of the second module 102*b*, for example, by plug weld through the openings 228 of first column 108*a* while the second module 102*b* is stacked on the top of the first module 102*a*. The second plate 222 may be plug welded to the first column 108*a* through four openings 228 each at one side surface of the first column 108*a*.

The first plate 206, the alignment pin 212, and the second plate 222 are installed in at least two columns of each module, for example, the two opposing columns in a diagonal direction of each module. It is also possible that the first plate 206, the alignment pin 212, and the second plate 222 may be installed in more than two columns of each module, or any other configurations as desired.

Figure 4:
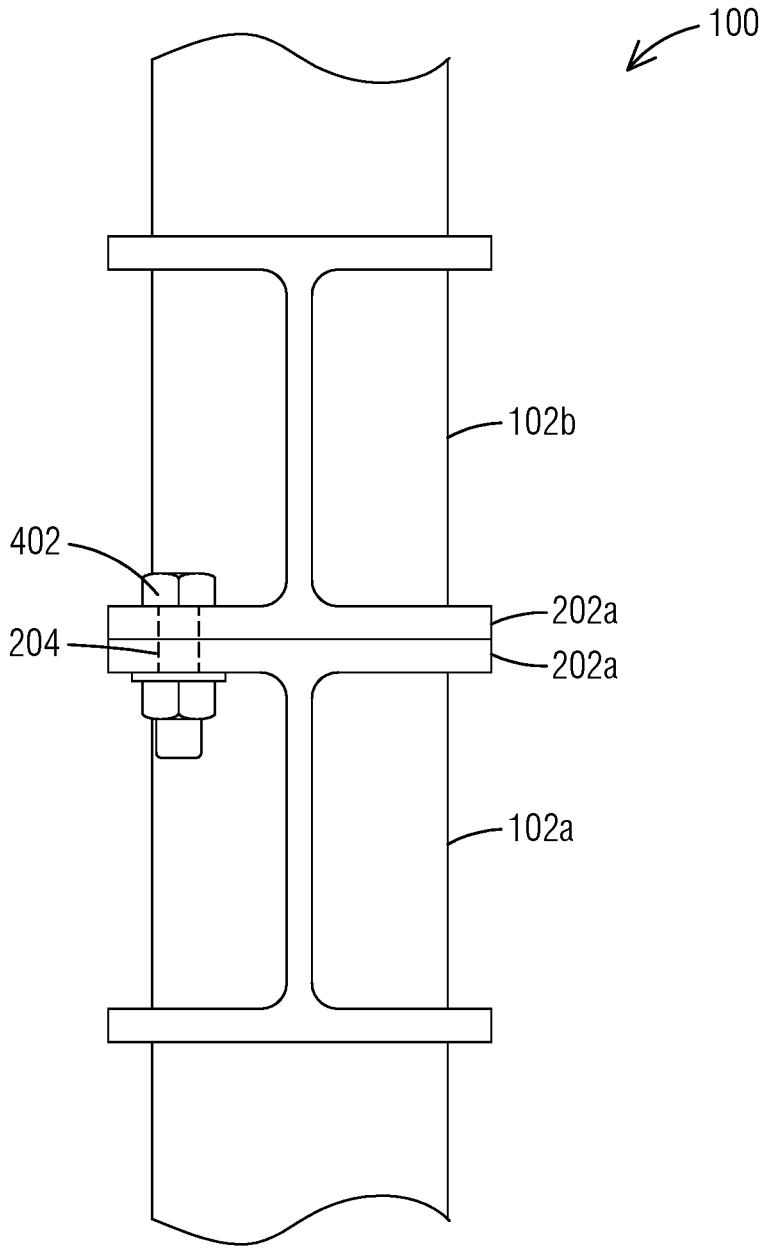
FIG. 4 illustrates a side view of the portion of the system in FIG. 2.

FIG. 4 illustrates a side view of the portion of the system 100 in FIG. 2. At least one fastener 402 fastens the first module 102*a* to the second module 102*b* through the aperture 204 on the two first panels 202*a* of the first module 102*a* and the second module 102*b* that are in contact to each other after stacking. The fastener 402 may include, for example, a heavy hex structural bolt, washer, and nut. A plurality of fasteners 402 may be used to fasten the first module 102*a* and the second module 102*b* to each other. Similar configurations may apply to each pair of stacked modules.

Figure 5:
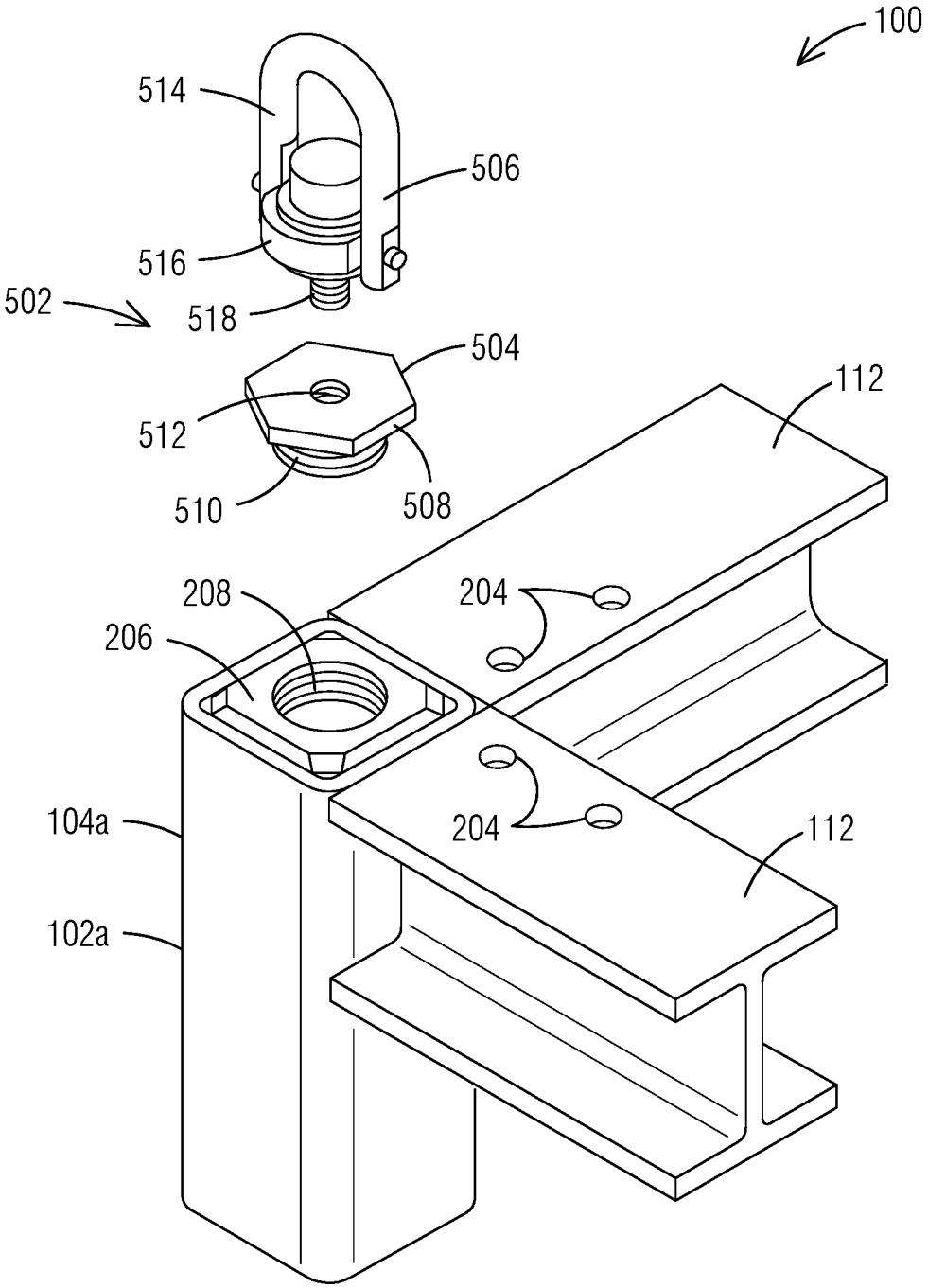
FIG. 5 illustrates a perspective exploded view of a portion of the system in FIG. 1 in a shipping configuration.

FIG. 5 illustrates a perspective exploded view of a portion of the system 100 in FIG. 1 in a shipping configuration. The system 100 includes a lifting package 502. The lifting package 502 includes a lifting adapter 504 and a lifting hoist ring 506. The lifting adapter 504 has a faceplate 508 and a rod 510 that extends from the faceplate 508. The rod 510 is a threaded cylinder. The lifting adapter 504 has an orifice 512 that is defined in the faceplate 508. The orifice 512 is threaded.

The lifting hoist ring 506 includes a lifting eye 514, a base plate 516, and a bar 518. The lifting eye 514 is attached to the base plate 516. The bar 518 extends from the base plate 516. The bar 518 has a cylindrical shape. The bar 518 has a threaded surface.

Figure 6:
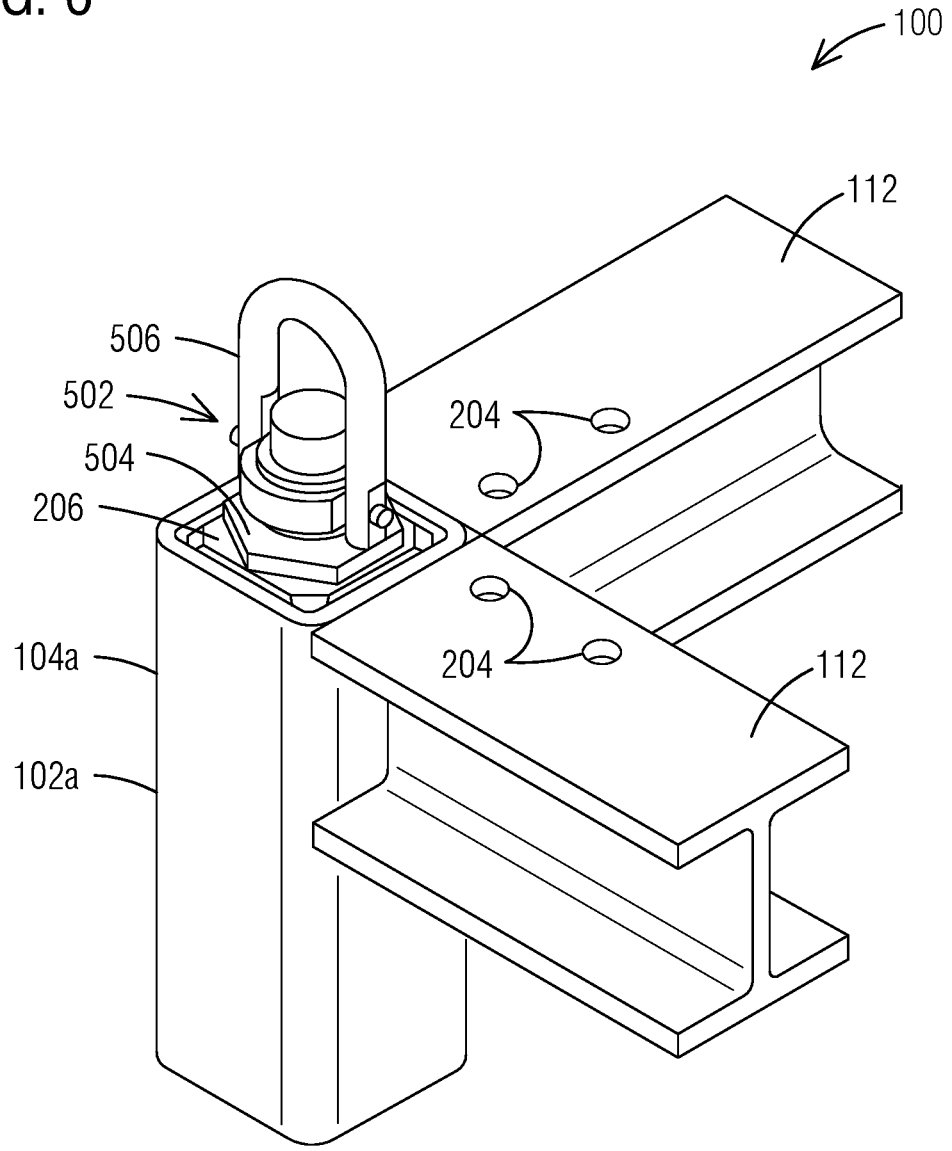
FIG. 6 illustrates a perspective assembled view of the portion of the system in FIG. 5 in the shipping configuration.

FIG. 6 illustrates a perspective assembled view of the portion of the system 100 in FIG. 5 in the shipping configuration. In the assembled shipping configuration, the lifting package 502 is installed into the first plate 206 that is attached in the first column 104*a* of the first module 102*a*. The lifting adapter 504 is installed into the first plate 206 by threading the rod 510 into the threaded hole 208 of the first plate 206. The lifting hoist ring 506 is installed into the lifting adapter 504 by threading the bar 518 into the orifice 512.

With references to FIG. 1 to FIG. 6, before shipping the plurality of modules to a site to be connected with an equipment, such as a gas turbine engine, the plurality of auxiliary packages are installed within the spaces defined in the plurality of modules. The installation of the plurality of auxiliary packages is done in a shop. Once installed, each module contains one of the plurality of auxiliary packages within the structural steel-framed module. The preinstalled auxiliary integrated modules are delivered to the site.

To ensure that the adjacent auxiliary packages are aligned to each other once the plurality of auxiliary integrated modules are assembled on the site, a test fit-up is performed in the shop. For illustration, only the test fit-up of the first module 102*a* and the second module 102*b* is described in detail. Similar steps apply to stack other modules.

In the test fit-up, the first module 102*a* is lifted in an upright position using a lifting machine, such as a crane, to engage with the lifting hoist ring 506 of the lifting package 502. The lifting hoist ring 506 is then removed from the lifting adapter 504. The lifting adapter 504 is removed from the first plate 206 that is attached at the top end of the first column 104*a* of the first module 102*a*. The alignment pin 212 is installed into the first plate 206 by threading the threaded surface 218 of the alignment pin 212 into the threaded hole 208 of the first plate 206. The alignment pin 212 may be threaded into the threaded hole 208 of the first plate 206 using a pin type spanner wrench that is engaged into the eyelet 220 of the alignment pin 212. The second plate 222 is set on the alignment pin 212 by placing the alignment pin 212 into the hole 224 of the second plate 222.

The second module 102*b* is lifted above the first module 102*a* using a lifting machine, such as a crane, to engage with a lifting package installed on a top plate of the first column 108*a* of the second module 102*b*. The second plate is loosely engaged with the alignment pin 212 so that it can be adjusted in an aligned position with respect to the first column 108*a* of the second module 102*b*. The aligned position allows the first column 108*a* of the second module 102*b* to slide over the second plate 222 when stacking the second module 102*b* on the top of the first module 102*a*. The aligned position also aligns the second auxiliary package 118 installed within the second space 110 of the second module 102*b* with the first auxiliary package 116 installed within the first space 106 of the first module 102*a* when the second module 102*b* is stacked on the top of the first module 102*a*. The first column 108*a* of the second module 102*b* slides over the second plate 222 to stack the second module 102*b* on the top of the first module 102*a*. The second plate 222 is loosely positioned into the second hollow interior 226 of the first column 108*a* of the second module 102*b* in the aligned position. The alignment between the first module 102*a* and the second module 102*b* enables all piping flanged connections, and any other connections in the first auxiliary package 116 and the second auxiliary package 118 that are installed within the first module 102*a* and the second module 102*b*, respectively, meeting a desired tolerance.

The second plate 222 is fixedly attached at the bottom end of the first column 108*a* of the second module 102*b* within the second hollow interior 226 while the second module 102*b* is stacked on the top of the first module 102*a*. The fixedly attachment includes a plug weld through the opening 228 on the first column 108*a* of the second module 102*b* while the second module 102*b* is stacked on the top of the first module 102*a*. The second plate 222 may be plug welded to the first column 108*a* of the first second module 102*b* through multiple openings 228 on the first column 108*a*.

The second module 102*b* is unstacked from the top of the first module 102*a* after plug welding the second plate 222 to the first column 108*a* of the second module 102*b*. The second plate 222 is further fixedly attached to the first column 108*a* of the second module 102*b* by fully welding the second plate 222 to the first column 108*a* of the second module 102*b* around a perimeter of the first column 108*a* after the second module 102*b* is unstacked from the top of the first module 102*a*. The second module 102*b* with the second plate 222 fixedly attached in the aligned position is then delivered to the site.

The alignment pin 212 is removed from the first plate 206 and delivered as a loose component to the site. The lifting adapter 504 is reinstalled into the first plate 206 attached in the first column 104*a* of the first module 102*a*. The lifting hoist ring 506 is reinstalled into the lifting adapter 504. The first module 102*a* is then delivered to the site in the shipping configuration.

On the site, the first module 102*a* is placed in its final location and in an upright position using a lifting machine, such as a crane, to engage with the lifting package 502. The lifting hoist ring 506 of the lifting package 502 is then removed from the lifting adapter 504. The lifting adapter 504 is removed from the first plate 206 that is attached in the first column 104*a* of the first module 102*a*. The alignment pin 212 is installed into the first plate 206 that is attached at the top end of the first column 104*a* of the first module 102*a*. The second module 102*b* is stacked on the top of the first module 102*a* by sliding the second plate 222 that is fixedly attached at the bottom end of the first column 108*a* of the second module 102*b* over the alignment pin 212 that is installed in the first plate 206 of the first module 102*a*. The tapered head 216 of the alignment pin 212 makes it easier to slide the second plate 222 over the alignment pin 212. The first column 108*a* of the second module 102*b* may need to be moved slightly to finely align the first module 102*a* with respect to the second module 102*b*. For example, the first column 108*a* of the second module 102*b* may need to be moved in a rage of +/−0.5 inch (+/−12.7 mm), or +/−0.25 inch (+/−6.35 mm) to finely tune the alignment between the first module 102*a* and the second module 102*b*. The first module 102*a* and the second module 102*b* are then fastened to each other by the fasteners 402 through the apertures 204 on the beams 112 of the first module 102*a* and the second module 102*b* that are in contact to each other after stacking. The plurality of of auxiliary packages that are integrated in the modules are aligned and do not require additional alignment on the site. Similar steps apply to stack other modules.

The system 100 enables the modules with the preinstalled auxiliary packages stackable and easy to install on the site. The stackable modules with the preinstalled auxiliary packages achieves a repeatable alignment of the modules and interface of the modules on the site. The stackable modules with the preinstalled auxiliary packages enables auto-align the modules on the site as they are stacked onto each other by sliding a respective second plate 222 that is fixedly attached to the bottom end of the first column 108*a* of the second module 102*b* in the aligned position into a respective alignment pin 212 that is attached to the top end of the first column 104*a* of the first module 102*a*. The stackable modules with the preinstalled auxiliary packages reduce site assembly work, reduce piping field welds, and reduce site material handling.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

LISTING OF DRAWING ELEMENTS

100 system
102*a* first module
102*b* second module
102*c* third module
102*d* fourth module
102*e* fifth module
102*f* sixth module
102*g* seventh module
102*h* eighth module
102*i* ninth module
102*j* tenth module
104*a* first column
104*b* second column
104*c* third column
104*d* fourth column
106 first space
108*a* first column
108*b* second column
108*c* third column
108*d* fourth column
110 second space
112 beam
114 bridge platform
116 first auxiliary package
118 second auxiliary package
202*a* first panel
202*b* second panel
202*c* third panel
204 aperture
206 first plate
208 threaded hole
210 first hollow interior
212 alignment pin
214 cylindrical base
216 tapered head
218 threaded surface
220 eyelet
222 second plate
224 hole
226 second hollow interior
228 opening
402 fastener
502 lifting package
504 lifting adapter
506 lifting hoist ring
508 faceplate
510 rod
512 orifice
514 lifting eye
516 base plate
518 bar

What is claimed is:

1. A system for assembling modules, the system comprising:

a first module having a first set of columns that cooperate to define a first space, a first column of the first set of columns defining a first hollow interior;

a second module having a second set of columns that cooperate to define a second space, a first column of the second set of columns defining a second hollow interior;

a first plate fixedly attached to the first column of the first set of columns within the first hollow interior;

an alignment pin coupled to the first plate;

a second plate having a hole sized to receive the alignment pin, the second plate is engaged with the alignment pin to position the second plate in an aligned position with respect to the first column of the second set of columns; and an attachment member fixedly attached to the second plate and the first column of the second set of columns to fixedly attach the second plate in the aligned position within the second hollow interior.

2. The system of claim 1, further comprising:

a first auxiliary package that is installed within the first space, and a second auxiliary package that is installed within the second space, wherein the aligned position aligns the second auxiliary package with the first auxiliary package when the second module is assembled to the first module.

3. The system of claim 1, wherein the first plate is fixedly attached at a top end of the first column of the first set of columns, and wherein the second plate is fixedly attached at a bottom end of the first column of the second set of columns.

4. The system of claim 1, wherein the attachment member comprises a plug weld.

5. The system of claim 4, wherein the first column of the second set of columns defines an opening that cooperates with the plug weld to fixedly attach the second plate in the aligned position.

6. The system of claim 4, wherein the attachment member comprises a fully weld after the plug weld.

7. The system of claim 1, wherein the first plate comprises a threaded hole, and wherein the alignment pin comprises a threaded surface to couple the alignment pin to the first plate.

8. The system of claim 1, wherein the alignment pin has a cylindrical base and a tapered head.

9. The system of claim 1, wherein the first plate has a square shape, and wherein the first column of the first set of columns is a square tube to receive the first plate.

10. The system of claim 1, wherein the second plate has a square shape, and wherein the first column of the second set of columns is a square tube to receive the second plate.

11. The system of claim 1, wherein the first module comprises a beam disposed between two of the first set of columns.

12. The system of claim 11, wherein the second module comprises a beam disposed between two of the second set of columns.

13. A system for assembling modules, the system comprising:

a first module having a first set of columns that cooperate to define a first space, a first column of the first set of columns defining a first hollow interior;

a first auxiliary package installed within the first space;

a second module having a second set of columns that cooperate to define a second space, a first column of the second set of columns defining a second hollow interior;

a second auxiliary package installed within the second space;

a first plate fixedly attached at a top end of the first column of the first set of columns within the first hollow interior;

an alignment pin coupled to the first plate; and a second plate having a hole sized to receive the alignment pin, the second plate engaged with the alignment pin to position the second plate in an aligned position with respect to the first column of the second set of columns that aligns the second auxiliary package with the first auxiliary package when the the second module is assembled to the first module, an attachment member fixedly attached to the second plate and the first column of the second set of columns to fixedly attach the second plate in the aligned position at a bottom end of the first column of the second set of columns within the second hollow interior.

14. The system of claim 13, wherein the attachment member comprises a plug weld, and wherein the first column of the second set of columns defines an opening that cooperates with the plug weld to fixedly attach the second plate in the aligned position.

15. The system of claim 14, wherein the attachment member comprises a fully weld after the plug weld.

16. The system of claim 13, wherein the first plate comprises a threaded hole, and wherein the alignment pin comprises a threaded surface to couple the alignment pin to the first plate.

17. The system of claim 13, wherein the alignment pin has a cylindrical base and a tapered head.

18. A method for assembling modules, the method comprising:

arranging a first module having a first set of columns that cooperate to define a first space, a first column of the first set of columns defining a first hollow interior;

installing a first auxiliary package within the first space;

arranging a second module having a second set of columns that cooperate to define a second space, a first column of the second set of columns defining a second hollow interior;

installing a second auxiliary package within the second space;

fixedly attaching a first plate at a top end of the first column of the first set of columns within the first hollow interior;

coupling an alignment pin to the first plate;

positioning a second plate on the alignment pin, the second plate comprising a hole to receive the alignment pin;

adjusting a position of the second plate in an aligned position with respect to the first column of the second set of columns;

stacking the second module on a top of the first module by sliding the first column of the second set of columns over the second plate to place the second plate in the aligned position within the second hollow interior that aligns the second auxiliary package with the first auxiliary package; and fixedly attaching the second plate to the first column of the second set of columns in the aligned position at a bottom end of the first column of the second set of columns within the second hollow interior.

19. The method of claim 18, wherein the fixedly attaching the second plate to the first column of the second set of columns in the aligned position comprises:

plug welding the second plate to the first column of the second set of columns while the second module is stacked on the top of the first module.

20. The method of claim 19, wherein the fixedly attaching the second plate to the first column of the second set of columns in the aligned position further comprises:

unstacking the second module from the top of the first module; and fully welding the second plate to the first column of the second set of columns after the unstacking.

* * * * *